US009113254B2

(12) United States Patent
Cotha

(10) Patent No.: US 9,113,254 B2
(45) Date of Patent: Aug. 18, 2015

(54) EARBUD WITH PIVOTING ACOUSTIC DUCT

(71) Applicant: GOOGLE TECHNOLOGY HOLDINGS LLC., Mountain View, CA (US)

(72) Inventor: Ajit C. Cotha, Atlanta, GA (US)

(73) Assignee: Google Technology Holdings LLC, Mountain View, CA (US)

( * ) Notice: Subject to any disclaimer, the term of this patent is extended or adjusted under 35 U.S.C. 154(b) by 0 days.

(21) Appl. No.: 13/958,772

(22) Filed: Aug. 5, 2013

(65) Prior Publication Data

US 2015/0036861 A1 Feb. 5, 2015

(51) Int. Cl.
*H04R 25/00* (2006.01)
*H04R 1/10* (2006.01)

(52) U.S. Cl.
CPC ..... *H04R 1/1058* (2013.01)

(58) Field of Classification Search
CPC ..... H04R 1/10; H04R 1/1058
USPC ..... 381/322, 328, 324, 370, 380; 379/430; 455/575.2
See application file for complete search history.

(56) References Cited

U.S. PATENT DOCUMENTS

| | | | | |
|---|---|---|---|---|
| 7,920,902 | B2 | 4/2011 | Carroll | |
| D647,081 | S | 10/2011 | Kwon | |
| D658,157 | S | 4/2012 | McManigal | |
| 8,189,845 | B2 | 5/2012 | Mulvey | |
| D666,996 | S | 9/2012 | Hardi et al. | |
| 2003/0206985 | A1 | 11/2003 | Gedritis et al. | |
| 2006/0098836 | A1* | 5/2006 | Sabick et al. | 381/380 |
| 2006/0279084 | A1 | 12/2006 | Collins | |
| 2009/0116677 | A1* | 5/2009 | Jones et al. | 381/380 |
| 2009/0232341 | A1 | 9/2009 | Pinter et al. | |
| 2010/0054493 | A1* | 3/2010 | Lin et al. | 381/74 |
| 2011/0180962 | A1 | 7/2011 | Aase et al. | |
| 2012/0087511 | A1* | 4/2012 | Lumsden et al. | 381/74 |
| 2012/0237074 | A1 | 9/2012 | Aase | |
| 2013/0031810 | A1 | 2/2013 | Auger et al. | |
| 2013/0163803 | A1 | 6/2013 | Erdel | |

FOREIGN PATENT DOCUMENTS

CN 201830425 U 5/2011

OTHER PUBLICATIONS

SkullCandy: http://www.skullcandy.com/shop/headphones/earphones-and-earbuds; have in-ear buds that conform/flex/rotate, downloaded from internet May 20, 2013, one page.

Bose: http://www.bose.com/controller?url=/shop_online/headphones/audio_headphones/in_ear_headphones/index.jsp, downloaded from internet: May 20, 2013, one page.

* cited by examiner

*Primary Examiner* — Tuan D Nguyen

(57) ABSTRACT

An earbud (100) includes an acoustic duct (201) and a driver sub-housing (202). The acoustic duct and driver sub-housing can be integrally manufactured via a two-shot injection molding process. The acoustic duct can be rigid while the driver sub-housing is flexible and/or pliant to flex when the acoustic duct pivots relative to the driver sub-housing.

17 Claims, 6 Drawing Sheets

EARBUD WITH PIVOTING ACOUSTIC DUCT

BACKGROUND

1. Technical Field

This disclosure relates generally to electronic devices, and more particularly to earbud acoustic devices.

2. Background Art

Wired and wireless headsets are commonly used with many portable electronic devices. For example, wired headsets can be used with a multimedia player, such as an MPEG-3 music player, to listen to music. Modern headsets take many forms, including over the ear clip on devices and over the head headphones. The most compact headsets are manufactured as in the ear or in the ear canal earbuds. Earbuds generally include small speakers and fit into either the folds of the human ear or into the ear canal itself.

For an earbud to provide the best sound, it is desirable for it to properly fit the user. Additionally, earbuds that do not fit properly can be very uncomfortable to wear after only a short period of use. At the same time, as people have vastly different shapes and sizes of ears, it is quite difficult for any one earbud to properly fit all users. Earbuds that do not properly fit frequently hold within the ear quite tenuously and tend to dislodge when the person moves vigorously. It would be advantageous to have an improved earbud that fit more users.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
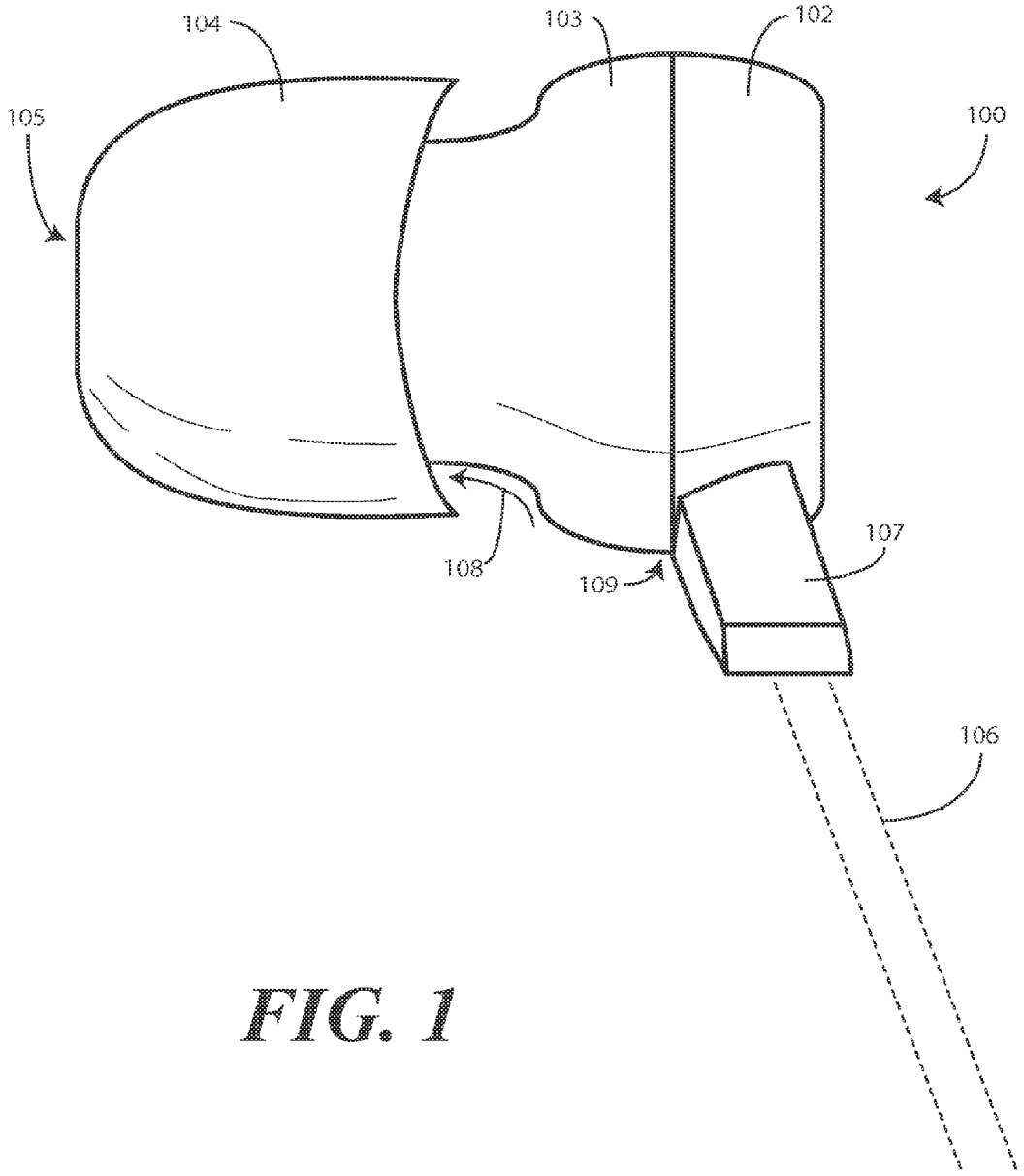
FIG. 1 illustrates one explanatory earbud configured in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

In the disclosure below, the apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein. Relational terms such as first and second, top and bottom, and the like may be used solely to distinguish one entity or action from another entity or action without necessarily requiring or implying any actual such relationship or order between such entities or actions.

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, reference designators shown herein in parenthesis indicate components shown in a figure other than the one in discussion. For example, talking about a device (10) while discussing figure A would refer to an element, 10, shown in figure other than figure A.

Embodiments of the disclosure provide an earbud that includes an acoustic duct and a driver sub-housing. In one embodiment, the driver sub-housing is pliant, while the acoustic duct is rigid. The driver sub-housing can contort to allow the acoustic duct to pivot to make micro-adjustments so that the earbud fits a larger number of ear canal sizes, configurations, and shapes. By allowing the acoustic duct to pivot relative to the driver sub-housing, as well as relative to an external housing in one or more embodiments, micro-adjustments in acoustic duct angle allows each user to acquire a better fit for their unique ear shape.

Embodiments of the disclosure provide a properly fitting earbud that secure well to a person's ear. Embodiments of the disclosure can seat better within a person's ear canal to assist in blocking environmental noise, thereby increasing overall sound quality. Embodiments of the disclosure are low cost to manufacture.

In one embodiment, the acoustic duct and driver sub-housing are manufactured by a two-shot molding process. A first shot of rigid thermoplastic resin, in molten form, can be injected into a mold to form the acoustic duct. A second shot of pliant thermoplastic resin, also in molten form, can be injected into the mold about at least a portion of the acoustic duct to create the driver sub-housing and to provide a circumferential seal about the acoustic duct. When the resulting assembly cures, the driver sub-housing is bonded to the acoustic duct. Moreover, the driver sub-housing can contort to allow the acoustic duct to pivot relative to the driver sub-housing to provide the micro-adjustability desired to ensure the earbud fits a variety of ears regardless of shape or ear canal angle.

Turning now to FIG. 1, illustrated therein is one embodiment of an earbud 100 configured in accordance with one or more embodiments of the disclosure. The earbud 100 includes an exterior housing 101. In this illustrative embodiment, the exterior housing 101 comprises an outer exterior housing 102 and an inner exterior housing 103. The outer exterior housing 102 is referred to as "outer" because it is farther from the user's ear when the earbud 100 is inserted into a user's ear. In one embodiment, the inner exterior housing 103 tapers 108 inward from a waist 109 of the exterior housing 101 to better fit within a user's ear canal.

An inner ear mount 104, manufactured from a pliant gel in this embodiment, is attached to an inner tip 105 of the earbud 100. The inner ear mount 104 is configured to squeeze within at least a portion of an ear canal of a user. The inner ear mount 104 can provide friction against the ear canal to grip the sides of the ear canal to retain the inner tip 105 reliably within the ear canal.

In one embodiment, the earbud 100 receives power and acoustic signals from one or more wires 106 that attach to a loudspeaker disposed within the exterior housing 101 (shown in FIG. 2 below). Optionally, one or more mechanical strain guides 107 can provide a circumferential seal about the one or more wires 106 as they enter the outer exterior housing 102.

Figure 2:
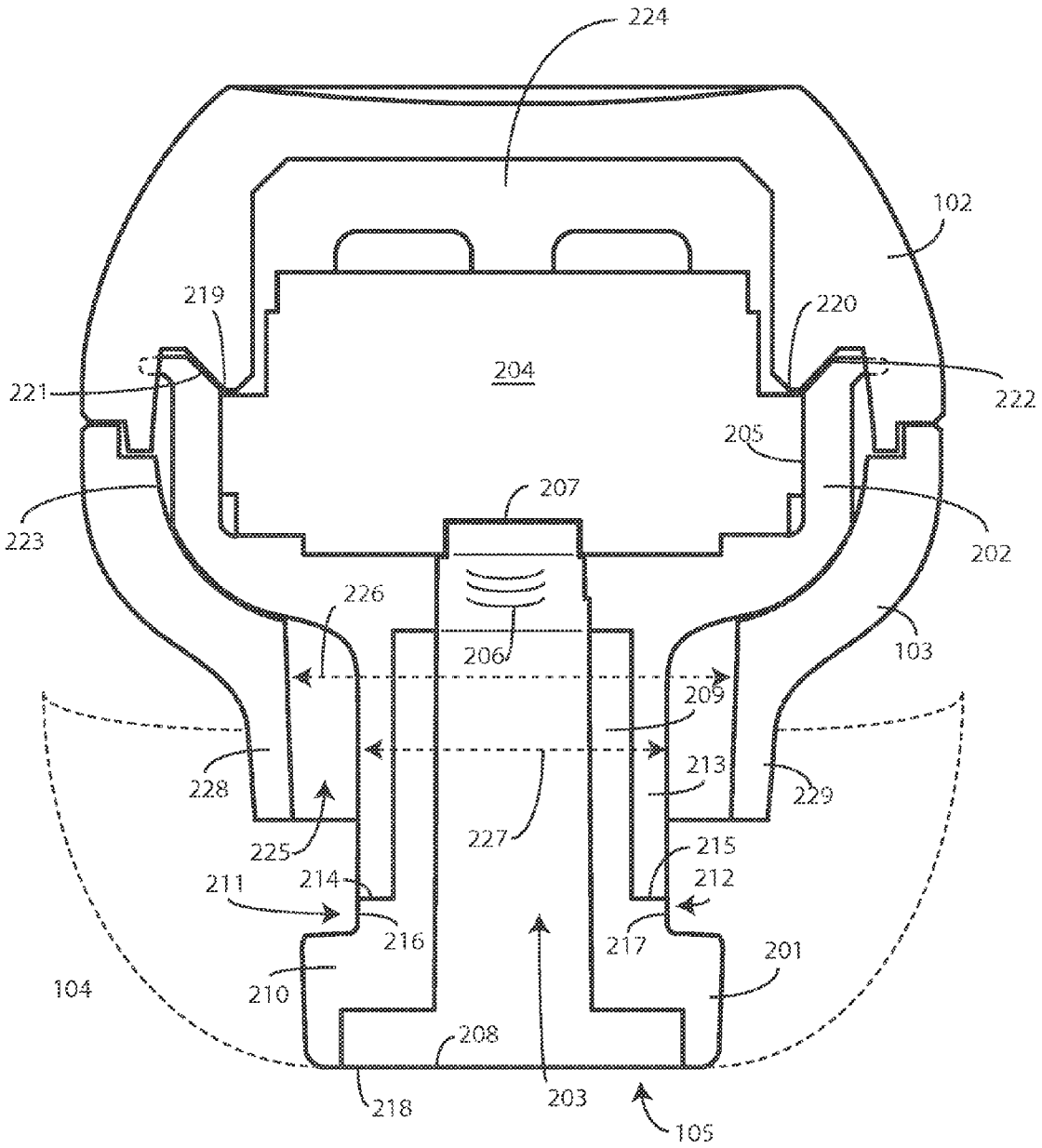
FIG. 2 illustrates one explanatory earbud configured in accordance with one or more embodiments of the disclosure.

Turning now to FIG. 2, a sectional view of the earbud is shown. As shown in FIG. 2, an inner assembly includes an acoustic duct 201 and a driver sub-housing 202. In this illustrative embodiment, the acoustic duct 201 comprises a T-shaped cross section and defines a front acoustic volume 203 for a loudspeaker 204 disposed within a bowl 205 of the driver sub-housing 202. The front acoustic volume 203 provides an acoustic channel for sound waves 206 to travel from a driver 207 of the loudspeaker 204 to a port 208 disposed at the inner tip 105 of the earbud 100.

In one embodiment, the acoustic duct 201 is bonded to the driver sub-housing 202. In one embodiment, the acoustic duct 201 is adhesively bonded to the driver sub-housing 202. In another embodiment, the acoustic duct 201 is thermally or sonically welded to the driver sub-housing 202. However, in another embodiment, the acoustic duct 201 and driver sub-housing 202 are manufactured by way of a two-shot injection molding process. Using a two-shot injection molding process provides a low-cost, highly reliable, and highly controllable process for manufacturing the acoustic duct 201 and the driver sub-housing 202. Accordingly, in one embodiment, the acoustic duct 201 is bonded to the driver sub-housing 202 by the two-shot injection molding process.

Illustrating by example, a mold may be formed with a cavity defining a negative of the acoustic duct 201 and the driver sub-housing 202. Each part can then be formed by a shot sequence including a first shot in which acoustic duct 201 is formed and a second shot in which driver sub-housing 202 is formed. This will be described in more detail below.

In some cases, the acoustic duct 201 and the driver sub-housing 202 could be molded using materials that are substantially different and that do not bond to one another. However, in most embodiments, the acoustic duct 201 and the driver sub-housing 202 can be made of materials that bond chemically to one another during the molding process so that any relative movement between acoustic duct 201 and the driver sub-housing 202 is prevented.

As noted above, in the illustrative embodiment of FIG. 2, the acoustic duct 201 has a T-shaped cross section defined by a base 209 and a cross member 210. Optional stair-steps 211,212 are disposed between the base 209 and the cross member 210 of the T-shaped cross section in this illustrative embodiment to provide flow stops for the stem 213 of the driver sub-housing 202. In this illustrative embodiment, each stair-step 211,212 includes a single stair 214,215 and a single riser 217,216 to form a single stair-step. In this embodiment, the single stair 214-215 is substantially orthogonal with the base 209 of the T-shaped cross section. The single riser 217, 216 is substantially parallel to the base 209 of the T-shaped cross section. Other embodiments will be obvious to those of ordinary skill in the art having the benefit of this disclosure. For example, multiple stair-steps could be disposed between the base 209 and the cross member 210 of the T-shaped cross section, or no steps can be theredisposed. Further, the stair(s) 214-215 can be non-orthogonal with the base 209 of the T-shaped cross section, and the riser(s) 217,218 can be non-parallel to the base 209 of the T-shaped cross section.

Where the acoustic duct 201 includes different components, such as the base 209 and cross member 210, while a two-shot injection molding process will be preferred in some embodiments, it will be obvious to those of ordinary skill in the art having the benefit of this disclosure that other methods can be used to construct the interior assembly as well. For example, in another embodiment, the acoustic duct 201 and driver sub-housing 202 can be manufactured with a three-shot injection molding process. A mold may be formed that includes selectable injection regions for the cross member 210, the base 209, and the driver sub-housing 202. In a first shot of the molding sequence, the cross member 210 may be formed from a highly rigid thermoplastic. In a second shot of the molding sequence, the base 209 could be molded from, for example, a semi-rigid thermoplastic. In a third shot of the molding sequence, the stem 213 of the driver sub-housing 202 could be molded to connect stem 213 with a circumferential seal about the base 209 to encase the base 209. In one or more embodiments, the stem 213 may comprise a material that bonds to the acoustic duct 201. As noted above, in one or more embodiments, the driver sub-housing 202 may be made of thermoplastic polyurethane (TPU) or of a thermoplastic elastomer (TPE).

In one embodiment, the acoustic duct 201 is manufactured from a rigid plastic material while the driver sub-housing 202 is manufactured from a pliant material. This configuration results in the acoustic duct 201 being rigid and the driver sub-housing 202 being pliant so as to flex when the acoustic duct 201 pivots relative to the driver sub-housing 202. This will be illustrated in more detail below.

In one embodiment, the acoustic duct 201 can be manufactured from nylon, styrene, ABS, polycarbonate, or polycarbonate-ABS, PMMA, PVC, or other polyamide-based thermoplastics in one embodiment. To be pliant to allow the acoustic duct 201 to pivot when its material flexes, in one embodiment the driver sub-housing 202 can be manufactured from nylon, TPU, TPE, or other pliant polyamide-type thermoplastics.

Figure 3:
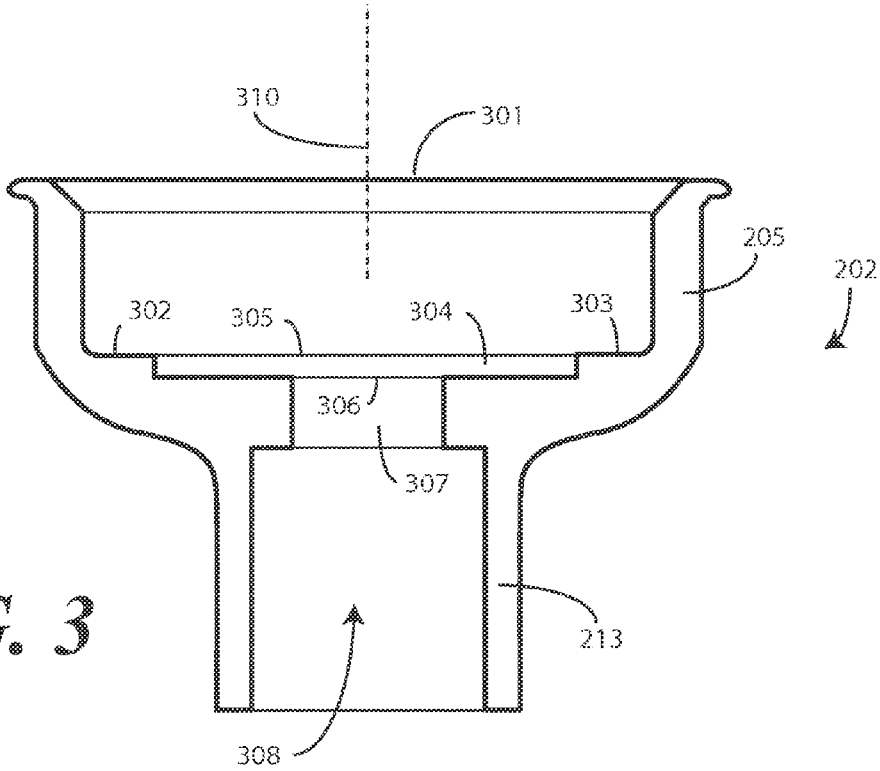
FIG. 3 illustrates an explanatory driver sub-housing configured in accordance with one or more embodiments of the disclosure.

Turning briefly to FIG. 3, illustrated therein is the driver sub-housing 202. As more clearly shown in FIG. 3, the driver sub-housing 202 is configured in a goblet shape. In this illustrative embodiment, the goblet shape is a footless goblet shape, as the driver sub-housing 202 comprises a bowl 205 and a stem 213, but no foot. In this illustrative embodiment, the bowl 205 is to receive a loudspeaker (204). The bowl has an opening 301 on a first side and loudspeaker receiving ledges 302,303 on a second side. When a loudspeaker (204) is inserted, the loudspeaker receiving ledges 302,303 serve as mechanical stops to limit the distance into the bowl 205 that the loudspeaker (204) can be inserted. Disposed between the loudspeaker receiving ledges 302,303 is an acoustic bay 304. The acoustic bay 304 is a recessed enclosed area disposed between the driver (207) of the loudspeaker (204) and the acoustic duct port 307. The acoustic bay 304 concentrates sound waves (206) from the driver (207) and delivers them to the front acoustic volume 203 of the acoustic duct (201).

The stem 213 of the driver sub-housing 202 includes an acoustic duct receiving well 308 into which at least a portion of the base (209) of the T-shaped cross section of the acoustic duct (201) is encased. In one embodiment, each of the acoustic bay 304, the acoustic duct port 307, and the acoustic duct receiving well 308 are axially aligned along a central axis 310 of the driver sub-housing 202. In this illustrative embodiment, each of the acoustic bay 304, the acoustic duct port 307, and the acoustic duct receiving well 308 are singular, in that each defines a single opening or passage way through the driver sub-housing 202. Those of ordinary skill in the art having the benefit of this disclosure will find other configurations obvious. For example, in other embodiments, each of the acoustic bay 304, the acoustic duct port 307, and the acoustic duct receiving well 308 can comprise a plurality of openings or passageways.

In the illustrative embodiment of FIG. 3, each of the acoustic bay 304, the acoustic duct port 307, and the acoustic duct receiving well 308 is cylindrical when viewed in cross section, i.e., when viewed along central axis 310. However, each of the acoustic bay 304, the acoustic duct port 307, and the acoustic duct receiving well 308 could take other cross-sectional shapes as well.

Turning now back to FIG. 2, the stem 312 of the footless goblet shape of the driver sub-housing 202 encases the base 209 of the T-shaped cross section of the acoustic duct 201. With the loudspeaker 204 disposed within the bowl 205 of the footless goblet shape, sound waves 206 are delivered to the front acoustic volume 203 of the acoustic duct 201. The front acoustic volume 203 defines a front acoustic volume for the driver 207 of the loudspeaker 204. The sound waves 206 then translate through the front acoustic volume 203 to an exit port 218 disposed at the inner tip 105 of the earbud 100. Where the inner ear mount 104 is disposed within the ear of the user, high fidelity, quality sound can be heard easily and comfortably.

In the illustrative embodiment of FIG. 2, the outer exterior housing 102 and an inner exterior housing 103 are coupled together around the interior assembly comprising the acoustic duct 201 and the integrally molded driver sub-housing 202. In one embodiment, the outer exterior housing 102 includes one or more loudspeaker seating ribs 219,220 that engage receiving walls 221,222 that slant outwardly from an interior of the bowl 205 of the footless goblet shape. These loudspeaker seating ribs 219,220 can ensure that the loudspeaker 204 is properly seated within the bowl 205. In one embodiment, where the driver sub-housing 202 is manufactured from a compliant material, the coupling of the outer exterior housing 102 and an inner exterior housing 103 compresses the driver sub-housing 202 between an interior wall 223 of the inner exterior housing 103. This compression "pulls" the outer exterior housing 102 down, as viewed in FIG. 2, and applies a pre-loading force against the loudspeaker 204 to provide an improved acoustic seal between the loudspeaker 204 and the bowl 205 of the footless goblet shape of the driver sub-housing 202.

In one embodiment, when the outer exterior housing 102 is attached about the driver sub-housing 202, a rear acoustic volume 224 is defined behind the loudspeaker 204. In one embodiment, the rear acoustic volume 224 is ported to provide an improved frequency response at the low end. Ported enclosures are well known in the art. The use of a port equalizes pressure on the front and rear sides of the loudspeaker's driver 207. When the driver 207 moves relative to the coupling of the outer exterior housing 102 and an inner exterior housing 103, the pressure within the rear acoustic volume changes. As the driver 207 moves into the outer exterior housing 102, internal pressure is increased. The inclusion of a port allows some of this pressure to funnel out of the port. When the driver 207 moves out of the outer exterior housing 102, the opposite occurs. The effect is air moving back and forth through the port, which increases the efficiency of the loudspeaker 204. Increased efficiency is important in headset design, especially where the earbud 100 is wireless, because such earbuds must work on battery power alone. Consequently, conservation of energy is preferred. Low-end frequency response can be increased through the use of ports without requiring additional amplification. While the earbud 100 of FIG. 2 is shown without ports, one or more ports could easily be added through the outer exterior housing 102 to provide a conduit between the rear acoustic volume and the outside world.

In one embodiment, the inner exterior housing 103 defines a conduit 225 for the base 209 of the T-shaped cross section of the acoustic duct 201. In this embodiment, the diameter 226 of the conduit 225 is greater than either the diameter 226 of the stem 213 or the diameter of the base 209 of the T-shaped cross section. This configuration allows the acoustic duct 201 to pivot within the conduit 225. At the same time, the sidewalls 228,229 of the conduit 225 can serve as mechanical stops for the acoustic duct 201 that limit the amount of pivot that can occur relative to the driver sub-housing 202, the inner exterior housing 103, or the outer exterior housing 102.

Figure 5:
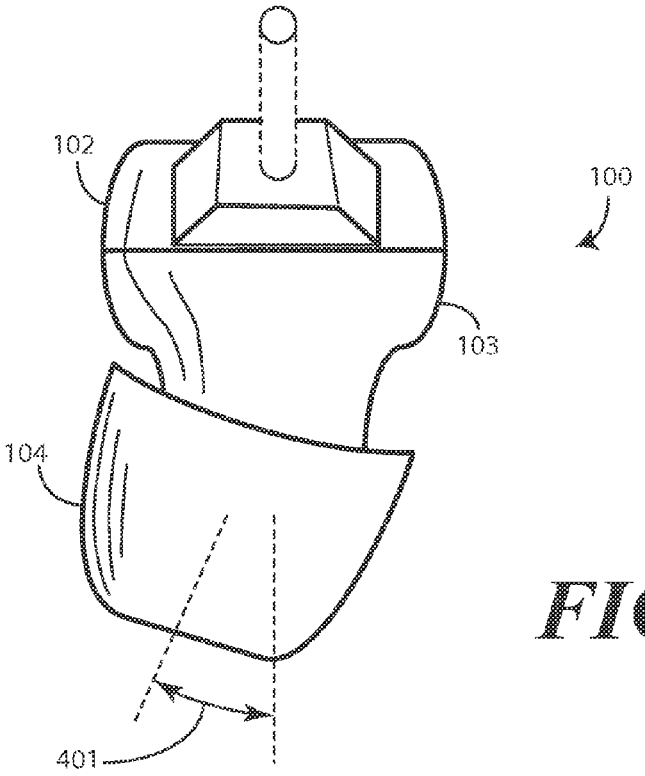
FIG. 5 illustrates an explanatory eadbud configured in accordance with one or more embodiments of the disclosure.
Figure 4:
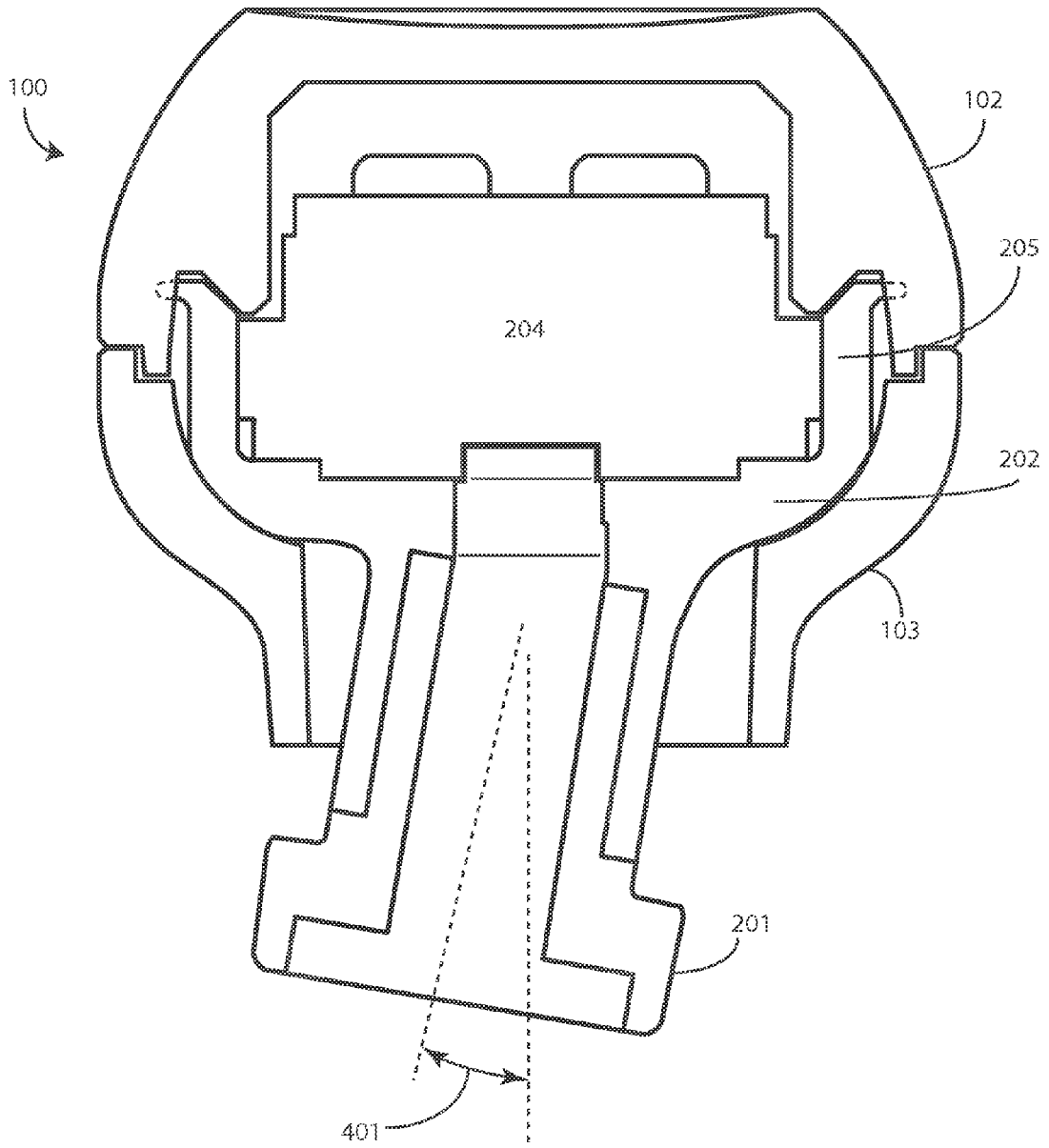
FIG. 4 illustrates an explanatory earbud configured in accordance with one or more embodiments of the disclosure.

Turning now to FIGS. 4 and 5, illustrated therein is the earbud 100 with the acoustic duct 201 pivoted relative to the inner exterior housing 103, the outer exterior housing 102, the loudspeaker 204, and the bowl 205 of the driver sub-housing 202. FIG. 4 illustrates a sectional view of the earbud 100, while FIG. 5 illustrates an exterior view of the same. The inner ear mount 104 is shown in FIG. 5, but is omitted from FIG. 4 for ease of illustration.

As noted above, in one embodiment, the acoustic duct 201 is rigid and the driver sub-housing 202 is pliant to flex when the acoustic duct 201 pivots 401 relative to the driver sub-housing 202. As shown in FIG. 4, this occurs when the flexible material forming the driver sub-housing 202 contorts to permit the acoustic duct 201 to pivot relative to not only the driver sub-housing 202, but the exterior housing formed by the inner exterior housing 103 and the outer exterior housing 102 of this illustrative embodiment. This "pivotability" allows the earbud 100 to fit a wide variety of ear shapes and configurations comfortably and easily.

Figure 6:
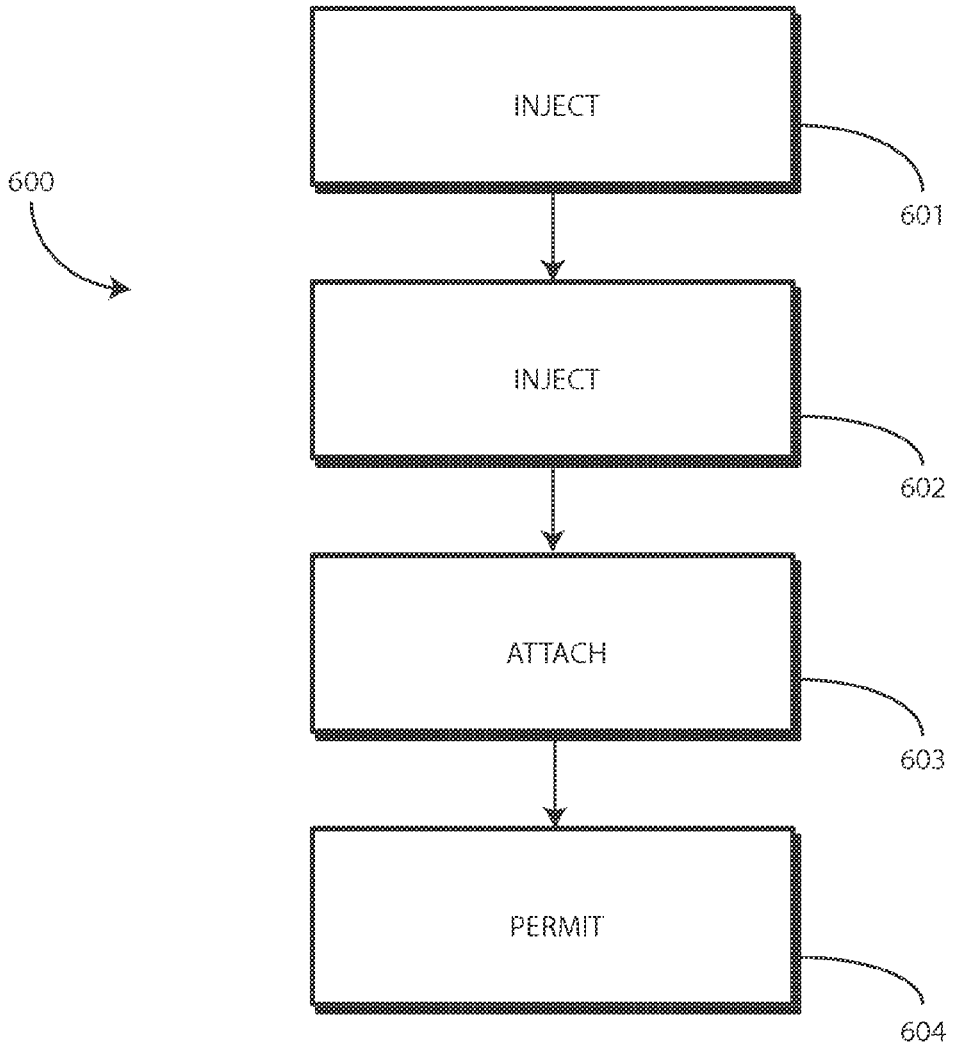
FIG. 6 illustrates an explanatory method configured in accordance with one or more embodiments of the disclosure.

Turning now to FIG. 6, illustrated therein is a method 600 of manufacturing an earbud in accordance with one or more embodiments of the disclosure. At step 601, a first shot of rigid thermoplastic resin in molten form is injected into a mold to create an acoustic duct. At step 602, a second shot of pliant thermoplastic resin in molten form is injected into the mold about the acoustic duct to create a driver sub-housing bonded to at least a portion of the acoustic duct.

At step 603, an exterior housing comprising a conduit wider than a stem of the driver sub-housing is attached to the driver sub-housing, thereby permitting the pliant thermoplastic to contort to allow the acoustic duct to pivot relative to the exterior housing. At step 604, the pliant thermoplastic resin is permitted to contort to allow the acoustic duct to pivot relative to the driver sub-housing.

The result of method 600, in one embodiment, is an earbud comprising a loudspeaker and a pivotable inner ear mount. In one embodiment, the earbud includes a loudspeaker. An exterior housing can define a rear acoustic volume and a front acoustic port as previously described. In one embodiment, the rear acoustic volume is sealed and is integral to the exterior housing. In one embodiment, the front volume is adjacent to a driver of the loudspeaker. In one embodiment, the driver sub-housing is manufactured from an elastomeric material. In one embodiment the driver sub-housing provides a circumferential seal that is integrally mated with the housing. In one embodiment, a stem of the driver sub-housing is further co-molded in a two-shot process with the acoustic duct. An inner ear mount, which in one embodiment is a gel or cushioned device disposed about an end of the acoustic duct, can then be pivoted to accommodate different ear shapes and sizes.

Figure 7:
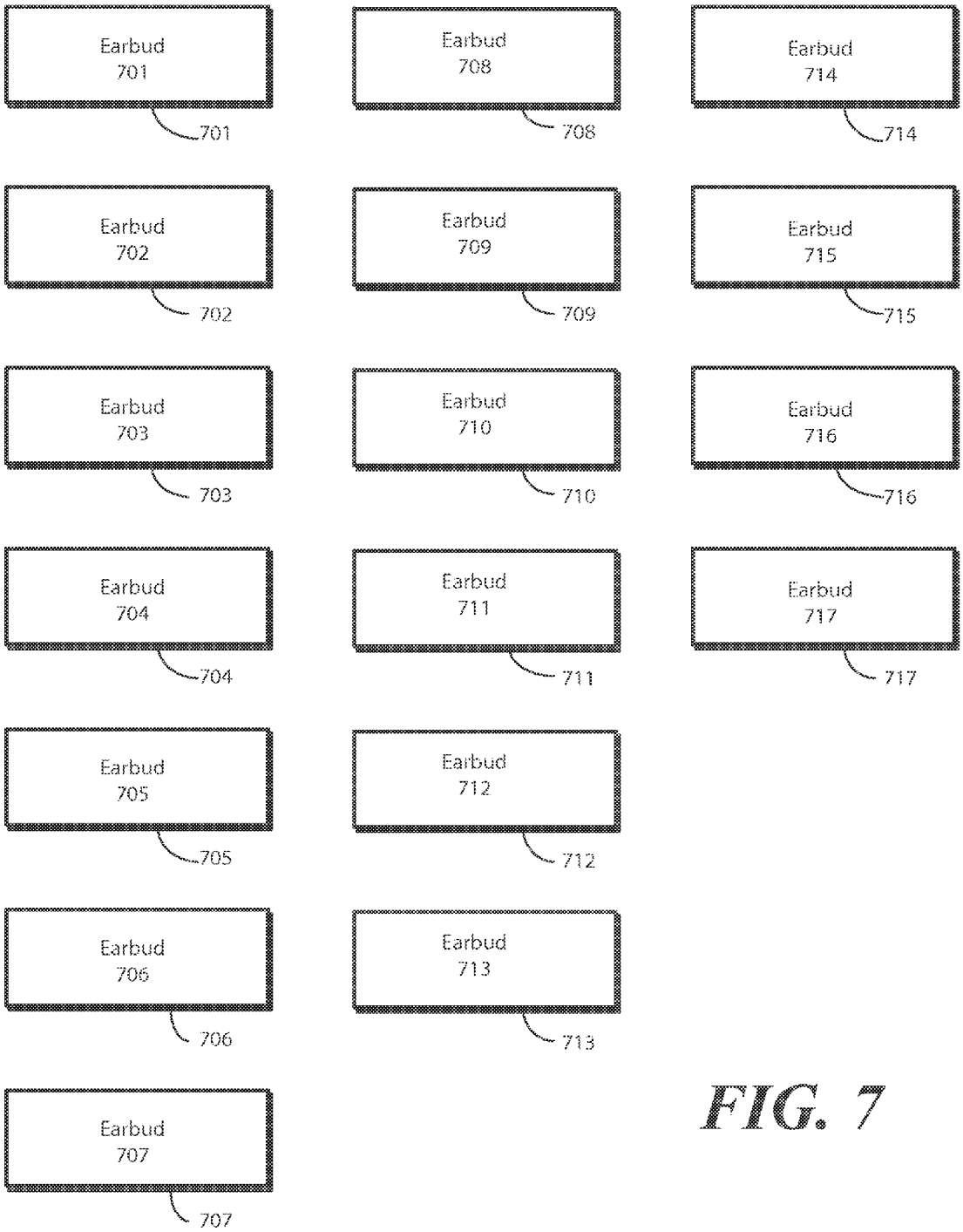
FIG. 7 illustrates various embodiments of the disclosure.

Turning now to FIG. 7, illustrated therein are various embodiments of the disclosure. At 701, an earbud comprises an acoustic duct and a driver sub-housing. At 701, the acoustic duct is rigid and the driver sub-housing is pliant to flex when the acoustic duct pivots relative to the driver sub-housing.

At 702, the driver sub-housing of 701 is bonded to the acoustic duct by a two-shot injection molding process. At 702, the acoustic duct of 701 comprises a T-shaped cross section. At 704, the acoustic duct of 702 comprises an optional stair-step between a base and a cross member of the T-shaped cross section. At 705, at least a portion of the base of the T-shaped cross section of 702 is circumferentially sealed by the driver sub-housing.

At 706, the driver sub-housing of 703 comprises a footless goblet shape. At 707, a stem of the footless goblet shape of 706 encases a base of the T-shaped cross section. At 708, a loudspeaker is disposed in a bowl of the footless goblet shape of 706.

At 709, the earbud of 701 includes an outer exterior housing enclosing the bowl of 708 to define a rear acoustic volume of the loudspeaker. At 710, the outer exterior housing of 709 comprises a rib extending into the bowl to seat the loudspeaker within the bowl. At 711, the earbud of 701 further comprises an inner exterior housing coupled to the outer exterior housing of 709.

At 712, the inner exterior housing of 711 defines a conduit for the base of the T-shaped cross section of 702. At 713, the conduit of 712 has a diameter greater than the stem. At 714, the conduit of 712 serves as a stop for the acoustic duct when the acoustic duct pivots relative to the driver sub-housing.

At 715, an earbud comprises a rigid acoustic duct at least partially bonded within a flexible driver sub-housing. At 715, a loudspeaker is disposed within a bowl of the flexible driver housing. At 715, an exterior housing is disposed about the loudspeaker to enclose the loudspeaker within the bowl. At 715, the exterior housing defines a conduit to permit the rigid acoustic duct to pivot relative to the exterior housing by contorting the flexible driver sub-housing.

At 716, the rigid acoustic duct of 715 is manufactured by a first shot of a two-shot injection molding process. At 717, the flexible driver sub-housing of 715 is manufactured by a second shot of the two-shot injection molding process.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. An earbud, comprising: an acoustic duct defining a longitudinal passage through the duct; and a driver sub-housing having a first portion and a stem portion extending from the first portion, wherein the stem portion of the driver sub-housing encases at least a portion of the acoustic duct, and wherein the acoustic duct is rigid and wherein the driver sub-housing is pliant to flex when the acoustic duct pivots relative to the first portion of the driver sub-housing.

2. The earbud of claim 1, the driver sub-housing being bonded to the acoustic duct by a two-shot injection molding process.

3. The earbud of claim 1, the acoustic duct comprising a T-shaped cross section.

4. The earbud of claim 3, the acoustic duct comprising a stair-step between a base and a cross member of the T-shaped cross section.

5. The earbud of claim 4, at least a portion of the base of the T-shaped cross section circumferentially sealed by the driver sub-housing.

6. The earbud of claim 1, wherein the first portion of the driver sub-housing comprises a footless goblet shape.

7. The earbud of claim 6, wherein the acoustic duct comprises a T-shaped cross section, and wherein the stem portion of driver sub-housing encases a base portion of the T-shaped cross section.

8. The earbud of claim 6, further comprising a loudspeaker disposed in a bowl of the footless goblet shape.

9. The earbud of claim 8, further comprising an outer exterior housing enclosing the bowl to define a rear acoustic volume of the loudspeaker.

10. The earbud of claim 9, the outer exterior housing comprising a rib extending into the bowl to seat the loudspeaker within the bowl.

11. The earbud of claim 9, further comprising an inner exterior housing coupled to the outer exterior housing.

12. The earbud of claim 11, the inner exterior housing defining a conduit for the base of the T-shaped cross section.

13. The earbud of claim 1, further comprising: an inner exterior housing that defines a conduit that surrounds a least part of the stem portion of the driver sub-housing, the conduit having a diameter greater than the stem portion.

14. The earbud of claim 13, the conduit defining a stop for the acoustic duct when the acoustic duct pivots relative to the driver sub-housing.

15. An earbud, comprising: a flexible driver sub-housing; a rigid acoustic duct at least partially bonded within a stem portion of the flexible driver sub-housing; a loudspeaker disposed within a bowl of the flexible driver sub-housing; and an exterior housing disposed about the loudspeaker to enclose the loudspeaker within the bowl, wherein the exterior housing defines a conduit that surrounds a least part of the stem portion of the driver sub-housing and that has a diameter greater than the stem portion to permit the rigid acoustic duct to pivot relative to the exterior housing by contorting the flexible driver sub-housing.

16. The earbud of claim 15, wherein the rigid acoustic duct is manufactured by a first shot of a two-shot injection molding process.

17. The earbud of claim 16, wherein the flexible driver sub-housing is manufactured by a second shot of the two-shot injection molding process.

* * * * *